United States Patent [19]

Gerber

[11] 4,004,808

[45] Jan. 25, 1977

[54] SPIRAL MANIPULATIVE GAME

[76] Inventor: Jon A. Gerber, 15 Bellewood Circle, North Syracuse, N.Y. 13212

[22] Filed: Mar. 29, 1976

[21] Appl. No.: 671,274

[52] U.S. Cl. ..... 273/108; 273/1 R

[51] Int. Cl.[2] ..... A63F 9/00

[58] Field of Search ..... 273/1 R, 1 E, 108–110, 273/112

[56] References Cited

UNITED STATES PATENTS

| | | | |
|---|---|---|---|
| 934,175 | 9/1909 | Hotchkiss | 273/108 |
| 1,509,490 | 9/1924 | Sawyer | 273/1 R |
| 1,853,901 | 4/1932 | Johnson | 273/108 |
| 2,021,395 | 11/1935 | Watmough | 273/1 R |
| 2,596,688 | 5/1952 | Hinsen | 273/112 |
| 2,834,597 | 5/1958 | Ylinen | 273/108 X |
| 2,877,597 | 3/1959 | Brant | 273/112 X |
| 3,306,612 | 2/1967 | Rosen | 273/1 R |
| 3,554,542 | 1/1971 | Span | 273/1 R |
| 3,581,408 | 6/1971 | Mohier | 273/1 R X |

FOREIGN PATENTS OR APPLICATIONS

| | | | |
|---|---|---|---|
| 746,533 | 3/1933 | France | 273/108 |
| 966,229 | 3/1950 | France | 273/1 E |

*Primary Examiner*—Richard J. Apley
*Attorney, Agent, or Firm*—Charles S. Mc Guire

[57] ABSTRACT

A game wherein a projectile is constrained for movement along a spiral path having a horizontally disposed axis. The projectile is engaged and propelled by hand-held elements manipulated by opposing players on opposite sides of the spiral path.

10 Claims, 3 Drawing Figures

SPIRAL MANIPULATIVE GAME

BACKGROUND OF THE INVENTION

The present invention relates to manipulative games for two players and, more particularly, to a game wherein a projectile is propelled in opposite directions along a spiral path by players on opposite sides of the means defining the path.

The principal object of the invention is to provide a game involving manual skill and agility for opposing players.

Another object is to provide an interesting and amusing game for two persons which is played with simple and inexpensive apparatus.

A further object is to provide a game involving opposed manual manipulation by two players of a projectile movable along a predetermined path to opposite goals.

Other objects will in part be obvious and will in part appear hereinafter.

BRIEF SUMMARY

The game is played with apparatus which comprises means defining a spiral path and a projectile constrained for essentially free movement along such path when propelled by players manipulating hand-held implements. The spiral path, preferably of constant diameter, is fixedly supported with its central axis horizontally disposed and with its mid-point on the lower side.

The projectile is initally placed at the mid-point and the opposing players are positioned in facing relation on opposite sides of the spiral path. Each players, preferably one or two on each side, is provided with an implement adapted to engage the projectile when it is at one of the low points in the spiral path and propel it upwardly on the manipulating players' side of the path. The upward propulsion causes the element to pass over the top of the next succeeding loop in the spiral and fall down the other side. By continued manipulation in this manner, the projectile is moved in opposite directions along the spiral path by opposing players until reaching one end of the path. Opposite ends of the path represent the "goals" of the players and the object of the game is to move the puck to the assigned goal. An appropriate audible or visual indicating means may be provided at each goal to provide a positive scoring indication.

DETAILED DESCRIPTION

Figure 1:
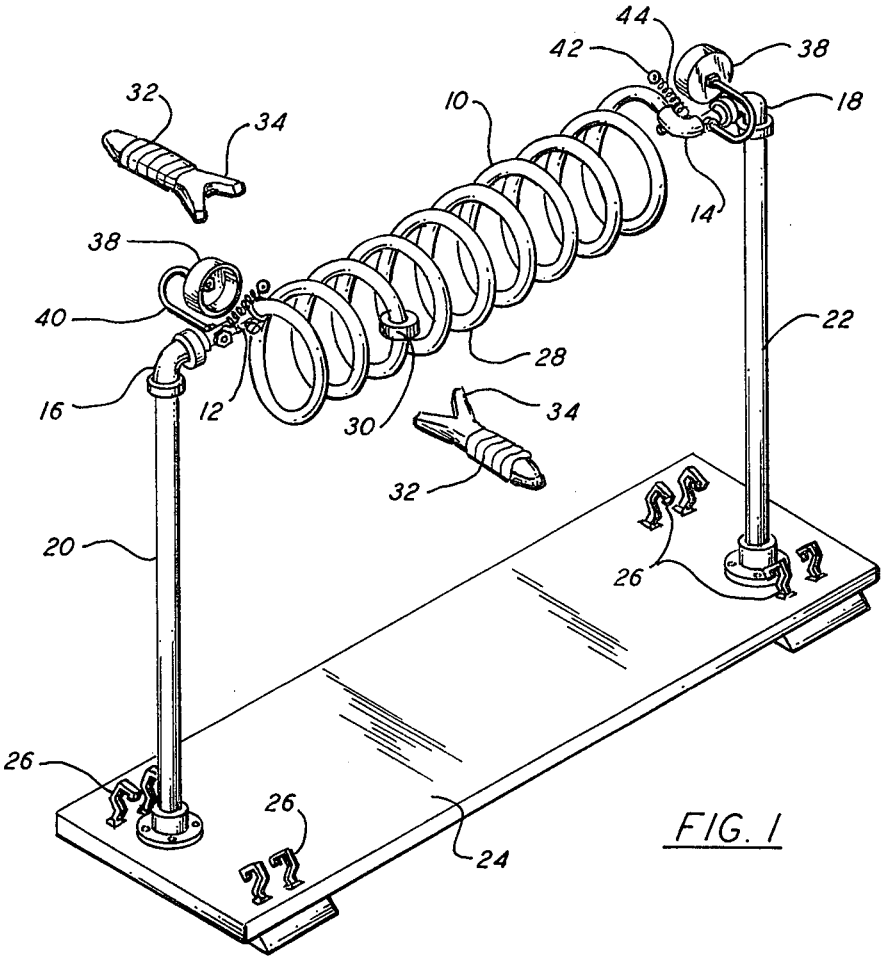
FIG. 1 is a perspective view of a preferred embodiment of the game apparatus.

Referring now to the drawing, in FIG. 1 is shown rigid spiral element 10 having end portions 12 and 14 fixedly attached to elbows 16 and 18, respectively, of upright posts 20 and 22. The latter are anchored in base 24 which rests upon a table, or other convenient support, and may be firmly secured thereto by means of suction cups manipulated by handles 26, or by magnets, or simply by its own weight.

Spiral element 10 is of circular cross section and is coiled in a spiral path of substantially constant pitch and diameter. The number of loops is preferably such that the mid-point between ends 12 and 14 is on the lower side, in the position indicated by reference numeral 28. Loosely encircling element 10 is short collar or sleeve 30 which may be propelled along the path defined by spiral element 10 by means of hand-held implements 32 having forked or notched end portions 34.

Figure 3:
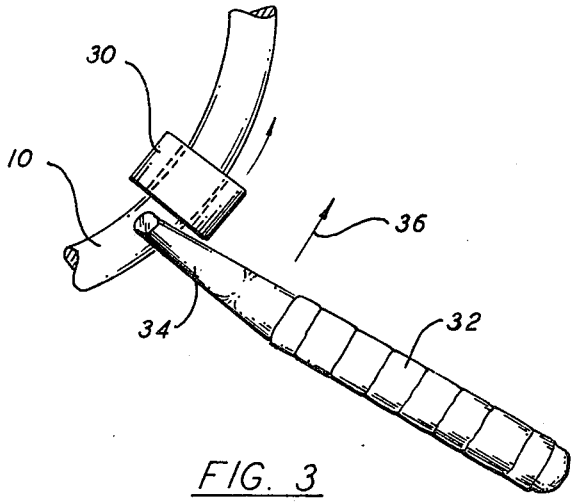
FIG. 3 is a fragmentary, elevational view of a medial portion of the apparatus, showing the manner of manipulation of the movable projectile.

The game is played by two players, or two teams of players, positioned on opposite sides of spiral element 10 and each holding a playing implement 32. Sleeve 30 is initially placed at mid-point 28 of spiral element 10. Sleeve 30 is moved along the spiral path defined by element 10 by placing notched end 34 of implement 32 against element 10, under the sleeve and moving the implement rapidly upward, as indicated by arrow 36 in FIG. 3. Sleeve 30 will then, if not intercepted by the opposing player, drop down the opposite side of spiral element 10, again reaching a point on the low side where it may again be engaged and propelled upwardly. Manipulation in this manner by the players on opposite sides of element 10 will obviously move sleeve 30 in opposite directions along the spiral path.

Figure 2:
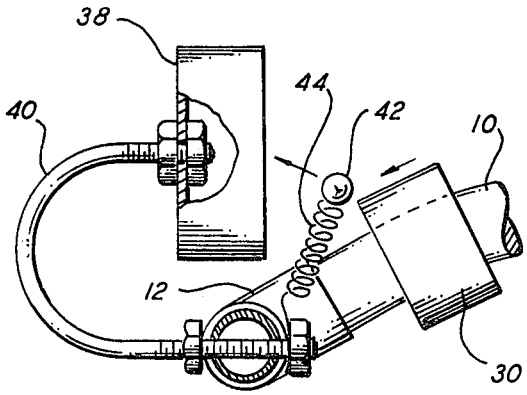
FIG. 2 is a fragmentary, elevational view of an end portion of the apparatus of FIG. 1.

The game is continued until one player succeeds in moving sleeve 30 to one of the terminal ends of spiral element 10. In order to indicate positively when sleeve 30 has reached a terminal end, thereby scoring a goal for one player, appropriate audible or visual signalling means may be provided for actuation in response to sleeve 30 reaching a terminal end. In the illustrated embodiment, such means are provided in the form of bells 38 supported on arms 40 adjacent each of ends 12 and 14. As best seen in FIG. 2, as sleeve 30 reaches a terminal end of element 10 it engages striker 42, resiliently supported at the free end of spring 44. Thus, each time a goal is scored, sleeve 30 pushes striker 42 against bell 38 to provide an audible signal.

It should be noted that the projectile may be movably secured to the means defining the spiral path other than by encircling the latter as in the illustrated embodiment. For example, the projectile could be constrained to move along a groove in the external periphery of a spiral element such as that shown. The spiral path, rather than being in the form of a solid element, may be defined by a slot in a cylindrical element. The end portions of the hand-held elements for manipulating the projectile would, of course, be shaped appropriately to the means defining the spiral path and to the projectile itself. The spiral element, or other means defining the spiral path, may be supported from above rather than from an underlying base. Other modifications within the scope of the invention are also apparent.

What is claimed is:

1. Spiral manipulative game apparatus comprising:

a. means defining a spiral path having terminal ends;

b. support means fixedly positioning said path-defining means with its central axis substantially horizontal;

c. a projectile movably attached to said path-defining means for free movement along said spiral path; and d. a pair of separate elements having end portions adapted to engage and propel said projectile along said path by manual manipulation of said elements by two players.

2. The invention according to claim 1 wherein said spiral path is of substantially constant diameter.

3. The invention according to claim 2 wherein said spiral path is of substantially constant pitch.

4. The invention according to claim 1 wherein said spiral path is defined by a rigid element formed in a spiral pattern.

5. The invention according to claim 4 wherein said projectile comprises a sleeve loosely encircling said spiral element.

6. The invention according to claim 4 wherein said rigid element is fixedly attached at its terminal ends to said support means.

7. The invention according to claim 6 wherein said support means comprise a pair of vertical posts anchored to a base member.

8. The invention according to claim 1 and further comprising indicating means constructed and arranged to provide a perceptible signal in response to said projectile reaching either of said terminal ends.

9. The invention according to claim 8 wherein said indicating means comprise mechanically actuated bells.

10. A method of playing a game employing a movable projectile constrained in a spiral path along a horizontal axis, said method comprising:

a. positioning a player on each side of the horizontal axis;

b. positioning the projectile at the center of the spiral path;

c. the players attempting to move the projectile in opposite directions along the path by propelling the projectile upwardly along the path on their respective sides of the axis; and d. continuing until the projectile reaches one end of the path.

* * * * *